US007224112B2

(12) United States Patent
Kato

(10) Patent No.: US 7,224,112 B2
(45) Date of Patent: May 29, 2007

(54) COLOR CATHODE-RAY TUBE

(75) Inventor: Atsushi Kato, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 433 days.

(21) Appl. No.: 10/911,941

(22) Filed: Aug. 4, 2004

(65) Prior Publication Data

US 2005/0029969 A1 Feb. 10, 2005

(30) Foreign Application Priority Data

Aug. 5, 2003 (JP) ..... 2003-287003

(51) Int. Cl.
*H01J 29/07* (2006.01)

(52) U.S. Cl. ..... 313/403; 313/402

(58) Field of Classification Search ..... 313/402, 313/403, 407

See application file for complete search history.

(56) References Cited

U.S. PATENT DOCUMENTS 5,378,959 A * 1/1995 Mancini ..... 313/402
6,639,345 B2 * 10/2003 Inoue et al. ..... 313/461
6,710,527 B2 * 3/2004 Kobayashi et al. ..... 313/402

FOREIGN PATENT DOCUMENTS

JP 56-76144 6/1981
JP 63-43241 2/1988

* cited by examiner

*Primary Examiner*—Ashok Patel
(74) *Attorney, Agent, or Firm*—Hamre, Schumann, Mueller & Larson, P.C.

(57) ABSTRACT

A shadow mask stretched in such a manner that tension is applied in a vertical direction includes a plurality of arrays of apertures in which a first aperture, a second aperture, a third aperture, and bridges between these apertures are aligned in a vertical direction. Assuming that a horizontal line passing through a center in the vertical direction of each bridge is a horizontal center line, and vertical spacings between the horizontal center lines of pairs of bridges that respectively sandwich the first aperture, the second aperture, and the third aperture in the vertical direction are $P_{Ba}$, $P_{Bb}$, and $P_{Bc}$ in this order, the relationships: $P_{Bb}=N1\times P_{Ba}$ and $P_{Bc}=N2\times P_{Ba}$ (N1, N2 are natural numbers, 1<N1<N2) are satisfied. Vertical spacings between the horizontal center lines with respect to all the bridges included in two arrays of apertures adjacent in the horizontal direction are substantially constant. Because of this, a color cathode-ray tube can be provided in which a horizontal streak pattern and color displacement due to doming can be reduced, and a display image quality is enhanced.

6 Claims, 10 Drawing Sheets

COLOR CATHODE-RAY TUBE

BACKGROUND OF THE INVENTION

1. Field of the Invention

The present invention relates to a color cathode-ray tube with a shadow mask.

2. Description of the Related Art

In a color cathode-ray tube, electron beams emitted from an electron gun pass through apertures formed in a shadow mask, and then strike a phosphor screen, thus causing phosphors to emit light.

As shown in FIG. 9, a shadow mask 95 is welded to a mask frame 96 in such a manner that tension is applied in a direction indicated by arrows 9 (a vertical direction, i.e., a Y-axis direction). The shadow mask 95 is provided with a large number of apertures 90, through which electron beams pass and reach a phosphor screen.

In such a tension-type shadow mask 95, the apertures 90 formed in the shadow mask 95 are shaped and arranged as follows. In general, a large number of substantially equi-shaped slot apertures 90 are aligned in such a manner that their longitudinal directions correspond to the Y-axis direction as shown in FIG. 10. Moreover, it is suggested that, for preventing breaking of the shadow mask and improving brightness, two kinds of apertures 90*a* and 90*b* having different lengths in the Y-axis direction are aligned in combination as shown in FIG. 11 (e.g., see JP63(1988)-43241A).

Since the electron beams are blocked by bridges 91 partitioning off two apertures 90 (or 90*a*, 90*b*) adjacent in the Y-axis direction in FIGS. 10 and 11, shadows are formed on the phosphor screen due to the bridges 91. Phosphors do not emit light in the shadow portions, so that the shadow portions become non-light-emitting regions. The presence of such non-light-emitting regions decreases the brightness of a displayed image.

Thus, in order to improve the brightness of a displayed image, it is preferable that the pitch in the Y-axis direction of the bridges 91 is increased to decrease the number thereof.

When the pitch in the Y-axis direction of the bridges 91 is increased, the spacing in the Y-axis direction of the shadows of the bridges 91 also is extended. Therefore, the shadows of the bridges are likely to be recognized, and the shadows dotted over the entire screen look continuous in the horizontal direction, and are recognized as black horizontal streaks.

On the other hand, when electron beams illuminate phosphor stripes, about 20% of the electron beams that have struck a shadow mask pass through the apertures of the shadow mask, so that the remaining 80% of the electron beams heat the shadow mask to expand it thermally. In the tension-type shadow mask 95 shown in FIG. 9, the tension applied in the Y-axis direction can absorb the thermal expansion in the Y-axis direction. However, the thermal expansion in the X-axis direction is transmitted via the bridges 91, so that the positions of the apertures 90 of the shadow mask are displaced in the X-axis direction, whereby so-called doming occurs. Due to this doming, the electron beams that pass through the apertures 90 cannot illuminate desired phosphor stripes on the phosphor screen, and so-called color displacement occurs.

In order to solve the above-mentioned problem, the transmission of thermal expansion in the X-axis direction only needs to be reduced, and it is considered that such reduction can be realized by reducing the number of the bridges 91 contributing to the transmission of thermal expansion. However, the reduction in number of the bridges 91 means the increase in pitch in the Y-axis direction of the bridges 91, which causes the above-mentioned horizontal streak pattern to be generated.

Thus, in a conventional shadow mask, it has been difficult to achieve both the reduction in a horizontal streak pattern and the prevention of color displacement due to doming.

SUMMARY OF THE INVENTION

The present invention solves the above-mentioned conventional problem, and its object is to provide a color cathode-ray tube in which a horizontal streak pattern and color displacement due to doming are reduced and a display image quality is enhanced.

In order to achieve the above-mentioned object, a color cathode-ray tube of the present invention includes a frame, and a shadow mask stretched on the frame in such a manner that tension is applied to the shadow mask in a vertical direction. The shadow mask includes a plurality of arrays of apertures in the vertical direction. The arrays of apertures include a first aperture, a second aperture, a third aperture, and bridges between the apertures. Assuming that a horizontal line passing through a center in the vertical direction of each of the bridges is a horizontal center line, and vertical spacings between the horizontal center lines of pairs of the bridges that respectively sandwich the first aperture, the second aperture, and the third aperture in the vertical direction are $P_{Ba}$, $P_{Bb}$, and $P_{Bc}$ in this order, the relationships: $P_{Bb}=N1\times P_{Ba}$ and $P_{Bc}=N2\times P_{Ba}$ (N1, N2 are natural numbers, $1<N1<N2$) are satisfied, and vertical spacings between the horizontal center lines with respect to all the bridges included in arbitrary pairs of the arrays of apertures adjacent in a horizontal direction are substantially constant.

These and other advantages of the present invention will become apparent to those skilled in the art upon reading and understanding the following detailed description with reference to the accompanying figures.

DESCRIPTION OF THE PREFERRED EMBODIMENTS

According to a color cathode-ray tube of the present invention, a color cathode-ray tube can be provided, in which a horizontal streak pattern and color displacement due to doming are reduced, and a display image quality is enhanced.

In the color cathode-ray tube of the present invention, it is preferable that the vertical spacing between the horizontal center lines of the pair of the bridges that sandwich an aperture having a largest vertical width in the vertical direction, among the apertures included in the arrays of apertures, is 3 mm or less. Because of this, the generation of a horizontal streak pattern can be prevented further.

Furthermore, in the color cathode-ray tube of the present invention, it is preferable that assuming that horizontal widths of the first aperture, the second aperture, and the third aperture are $W_a$, $W_b$, and $W_c$, respectively, the relationships: $W_a>W_b$ and $W_a>W_c$ are satisfied. Furthermore, it is more preferable that the relationship: $W_a>W_b>W_c$ is satisfied. Because of this, first, in the case of forming phosphor stripes on a phosphor screen by an exposure method, using a shadow mask as an exposure mask, phosphor stripes with a uniform width can be formed easily. Second, a brightness difference over an entire screen can be decreased to enhance a display quality.

Furthermore, in the color cathode-ray tube of the present invention, it is preferable that the bridges included respectively in arbitrary pairs of the arrays of apertures adjacent in the horizontal direction are not aligned side by side in the horizontal direction. Because of this, the occurrence of doming can be prevented further.

Furthermore, it is preferable that the color cathode-ray tube of the present invention includes an aperture arrangement pattern in which a repeating unit including two of the arrays of apertures adjacent in the horizontal direction is repeated in the horizontal direction. Because of this, the design of the aperture arrangement pattern of the shadow mask can be simplified.

Hereinafter, a color cathode-ray tube of the present invention will be described with reference to the drawings.

Figure 1:
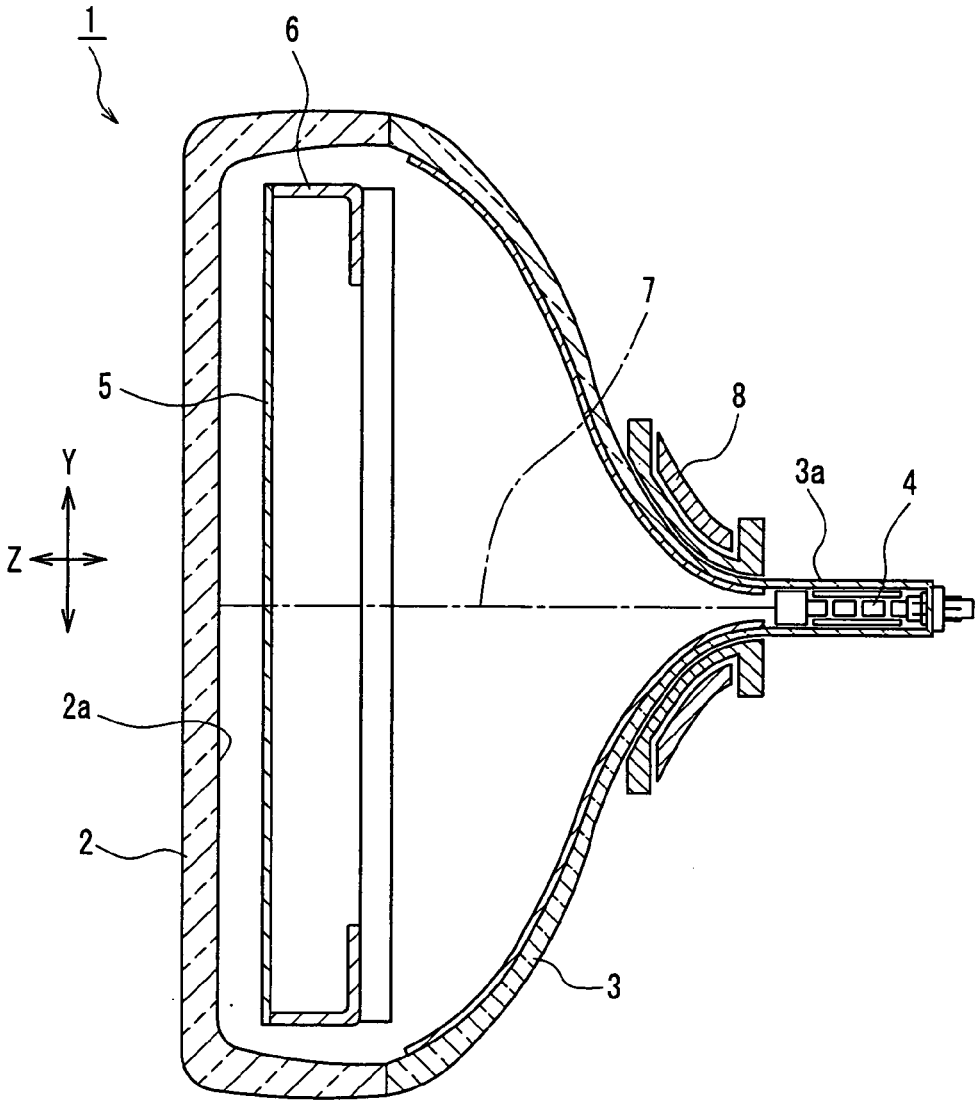
FIG. 1 is a side cross-sectional view showing one embodiment of a color cathode-ray tube of the present invention.

FIG. 1 shows one embodiment of a color cathode-ray tube of the present invention. A color cathode-ray tube 1 has an envelope including a funnel 3 and a panel 2 with a phosphor screen 2*a* formed on its inner surface. An electron gun 4 is provided in a neck portion 3*a* of the funnel 3. A shadow mask 5 facing the phosphor screen 2*a* is supported by a mask frame 6, which is attached to a panel pin (not shown) provided on an inner wall of the panel 2 via a spring (not shown). Further, outside the funnel 3, a deflection yoke 8 is provided for deflecting and scanning three electron beams 7 emitted from the electron gun 4. For convenience of the following description, XYZ rectangular coordinates are set in which a tube axis is a Z-axis, a horizontal axis passing through the Z-axis is an X-axis, and a vertical axis passing through the Z-axis is a Y-axis.

Figure 2:
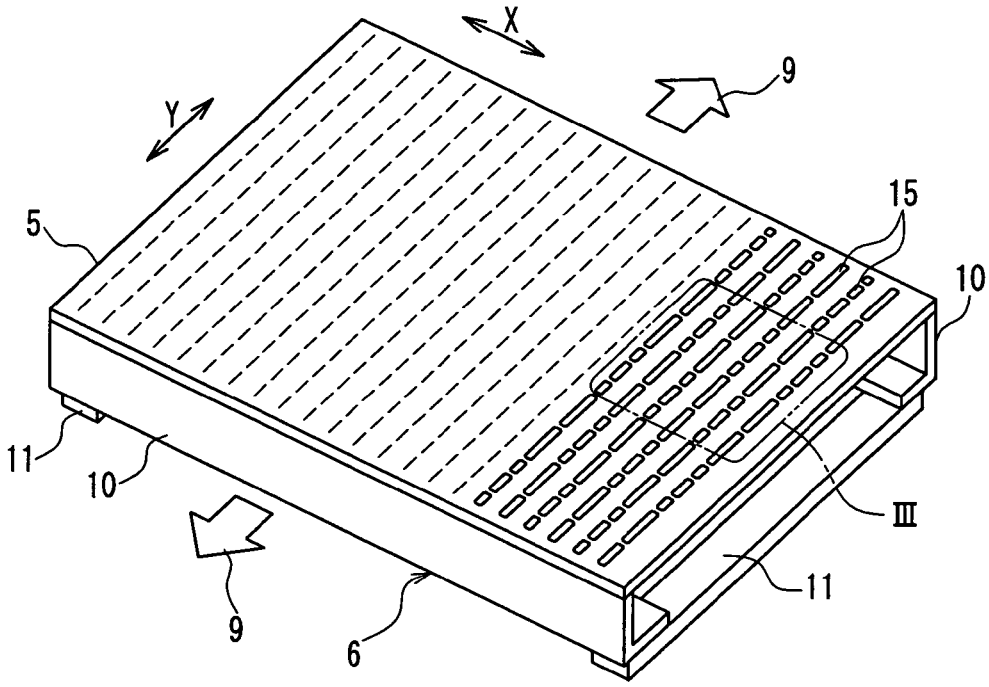
FIG. 2 is a perspective view showing one embodiment of an assembly including a shadow mask and a mask frame to be mounted on the color cathode-ray tube of the present invention.

FIG. 2 shows an assembly including the shadow mask 5 and the mask frame 6. The mask frame 6 is configured in such a manner that an opposed pair of supports 10 serving as long sides and an opposed pair of elastic members 11 serving as short sides are fixed so as to form a frame. The shadow mask 5 is welded to the pair of supports 10 with tension applied in a direction indicated by arrows 9 (a vertical direction, i.e., a Y-axis direction). In a horizontal direction (an X-axis direction) of the shadow mask 5, there are a large number of arrays of apertures 15. Each array of apertures 15 includes vertically aligned apertures for passing electron beams therethrough.

Figure 3:
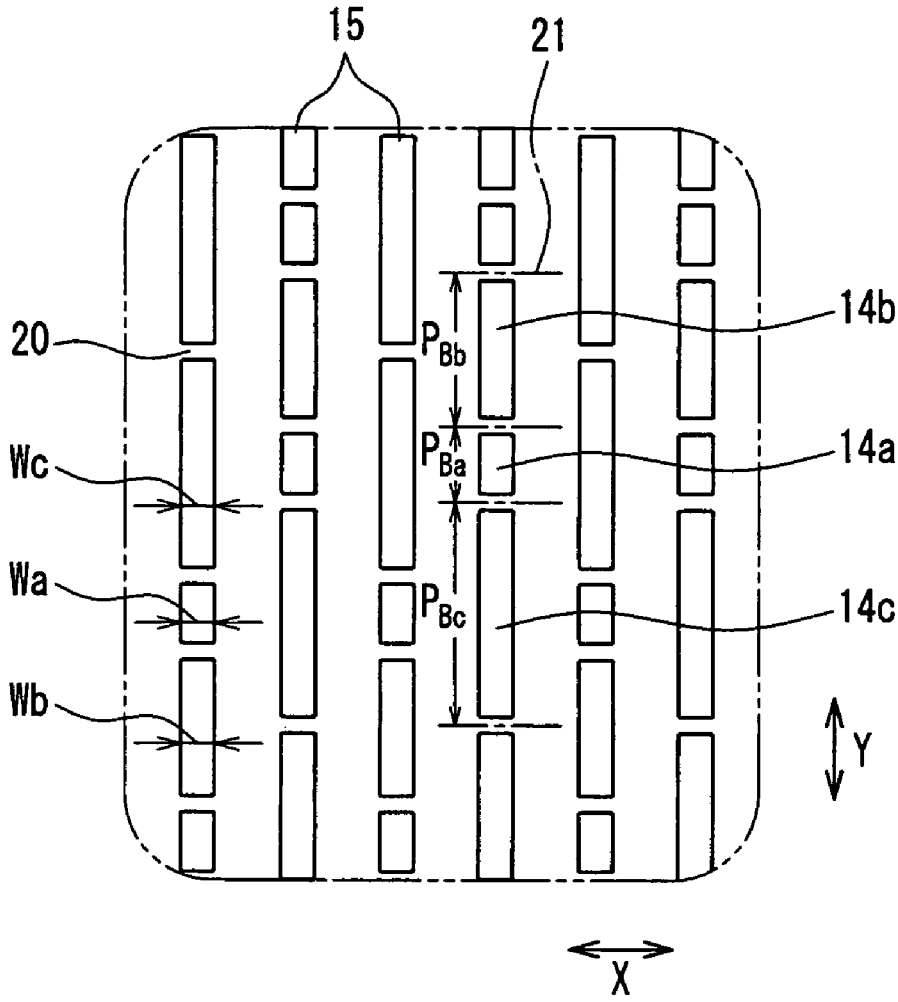
FIG. 3 is an enlarged front view of a portion III shown in FIG. 2.

FIG. 3 is an enlarged front view of a portion III shown in FIG. 2. Each array of apertures 15 includes first apertures 14*a*, second apertures 14*b*, and third apertures 14*c* in a substantially rectangular shape (slot shape) formed by etching, and bridges 20 between these apertures. The apertures 14*a*, 14*b*, and 14*c* satisfy the relationship: 14*a*<14*b*<14*c* in terms of a vertical width.

As shown in FIG. 3, it is assumed that a horizontal line passing through a center in the vertical direction of each bridge 20 is a horizontal center line 21. Furthermore, vertical spacings between the horizontal center lines 21, 21 of pairs of the bridges 20, 20 that respectively sandwich the apertures 14*a*, 14*b*, and 14*c* in the vertical direction are assumed to be $P_{Ba}$, $P_{Bb}$, and $P_{Bc}$ in this order. According to the present invention, when N1 and N2 are assumed to be natural numbers (1<N1<N2), the relationships: $P_{Bb}=N1\times P_{Ba}$, and $P_{Bc}=N2\times P_{Ba}$ are satisfied. The vertical widths of all the bridges 20 are substantially constant.

In the color cathode-ray tube of the present invention, a horizontal streak pattern and color displacement due to doming can be reduced by providing a shadow mask with apertures formed as described above. This will be described below.

First, the reduction in a horizontal streak pattern will be described.

Figure 4A:
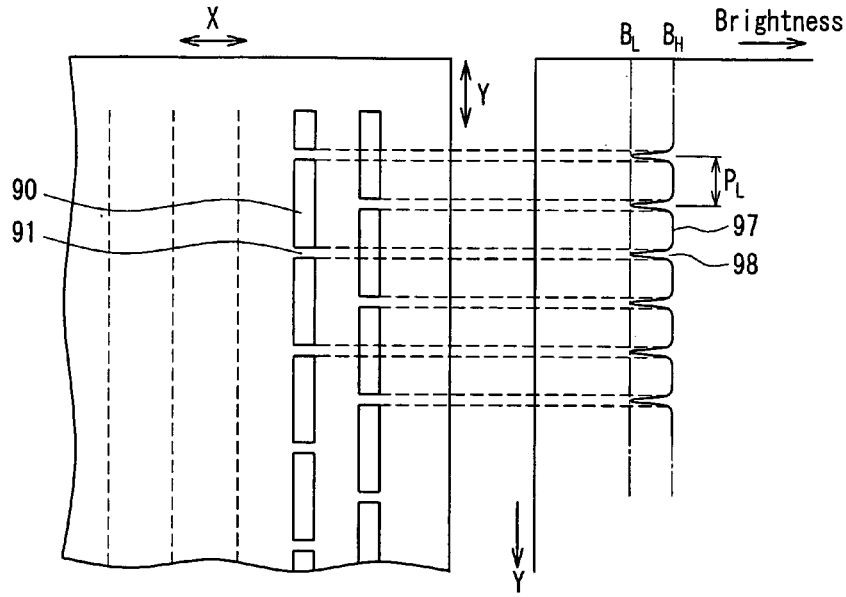
FIG. 4A PRIOR ART
FIGS. 4A and 4B are views illustrating the mechanism of the generation of a horizontal streak pattern in a conventional shadow mask.
Figure 4B:
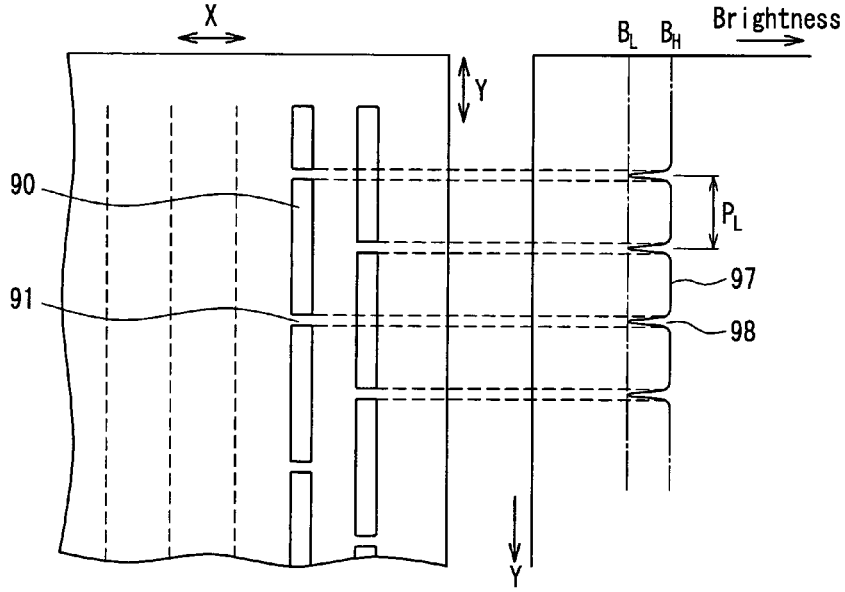
FIG. 4B PRIOR ART
Figure 10:
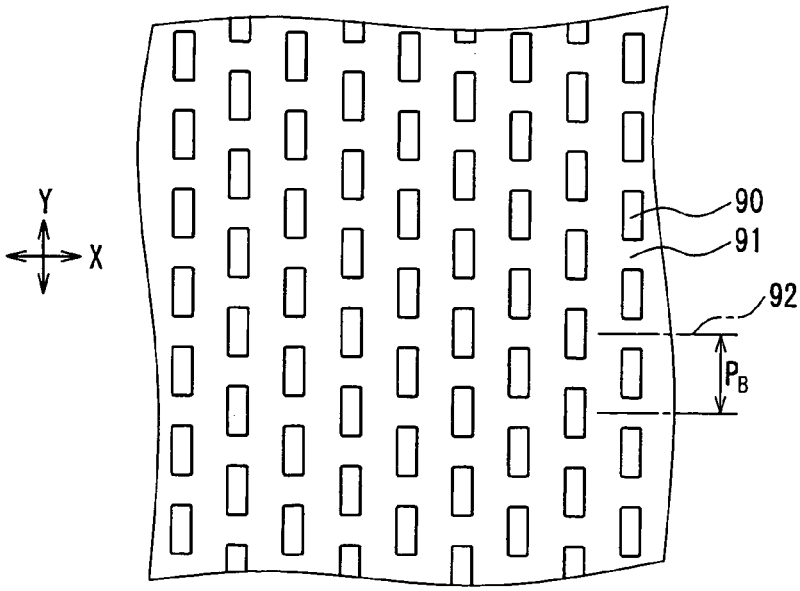
FIG. 10 PRIOR ART
FIG. 10 is a partially enlarged front view showing apertures formed in a shadow mask in the conventional color cathode-ray tube.
Figure 11:
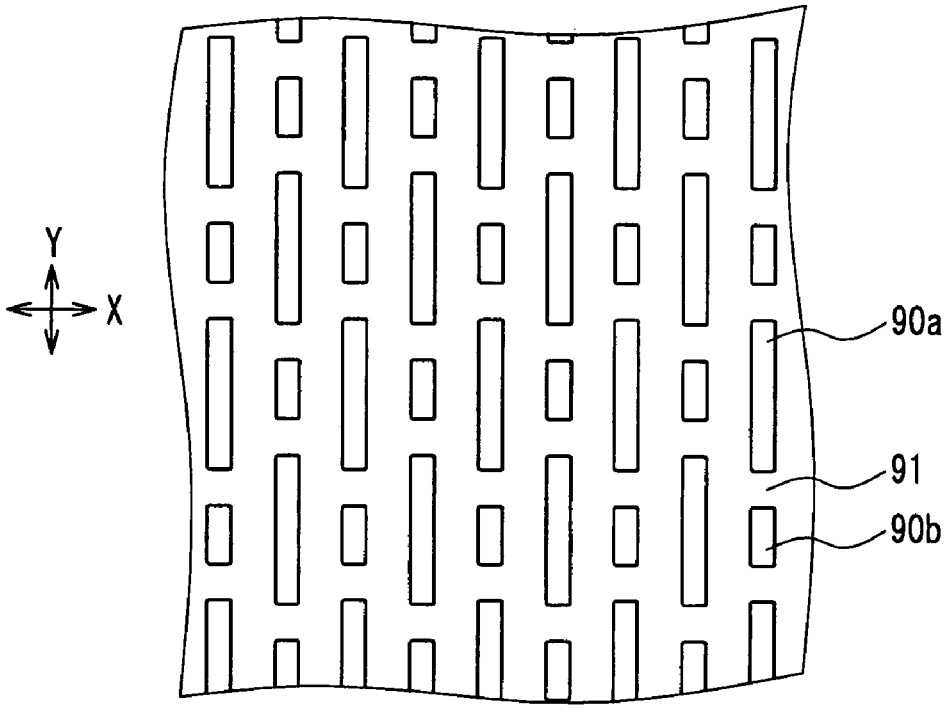
FIG. 11 PRIOR ART
FIG. 11 is a partially enlarged front view showing apertures formed in a shadow mask in another conventional color cathode-ray tube.

FIG. 4A is a view showing the case where the vertical pitch of bridges 91 is small in the tension-type shadow mask, in which a number of apertures 90 of the same size are formed, shown in FIG. 10. FIG. 4B is a view showing the case where the vertical pitch of the bridges 91 is large. In either of FIGS. 4A and 4B, the left-side view on the drawing surface is an enlarged front view showing the arrangement of the apertures 90 and the bridges 91, and the right-side view on the drawing surface is a brightness distribution diagram obtained by summing up two brightness distribution curves corresponding to two arrays of apertures adjacent in the horizontal direction shown on the left side of the drawing surface, among the brightness distribution curves in the vertical direction of phosphors that emit light due to electron beams passing through the apertures 90 aligned in the vertical direction, obtained for each array of apertures. The reason for summing up the two brightness distribution curves respectively corresponding to two adjacent arrays of apertures is as follows: light-emitting portions of phosphors respectively corresponding to two adjacent arrays of apertures are sufficiently close to each other in the horizontal direction that they are difficult to be distinguished by the naked eye.

In either of FIGS. 4A and 4B, a high brightness level BH is exhibited in a range 97 in the vertical direction, and the range 97 corresponds to a range in which the apertures 90 are arranged in any of the two adjacent arrays of apertures. On the other hand, a low brightness level $B_L$ is exhibited in a range 98 in the vertical direction, and the range 98 corresponds to a range in which the bridges 91 are arranged in one of the two adjacent arrays of apertures. The reason why the brightness level is low in the range 98 is that the phosphors do not emit light due to the shadows of the bridges 91.

A vertical pitch $P_L$ of portions exhibiting the low brightness level $B_L$ is larger in FIG. 4B than in FIG. 4A. There is a limit to the resolution with which the human eye is capable of recognizing a brightness difference. When the vertical pitch $P_L$ of the low brightness level $B_L$ is small as shown in FIG. 4A, the portions exhibiting the low brightness level $B_L$ cannot be recognized. However, when the vertical pitch $P_L$ of the low brightness level $B_L$ is large as shown in FIG. 4B, the portions exhibiting the low brightness level $B_L$ can be recognized. Since the bridges 91 whose vertical positions are matched with each other are arranged at a constant spacing in the horizontal direction, when the vertical pitch of the bridges 91 is increased as shown in FIG. 4B, the portions exhibiting the low brightness level $B_L$ are recognized as black horizontal streaks. The distance between the shadow mask and the phosphor screen is small, so that the vertical pitch $P_L$ is substantially matched with a bridge arrangement basic spacing $P_C$ (described later).

Figure 5:
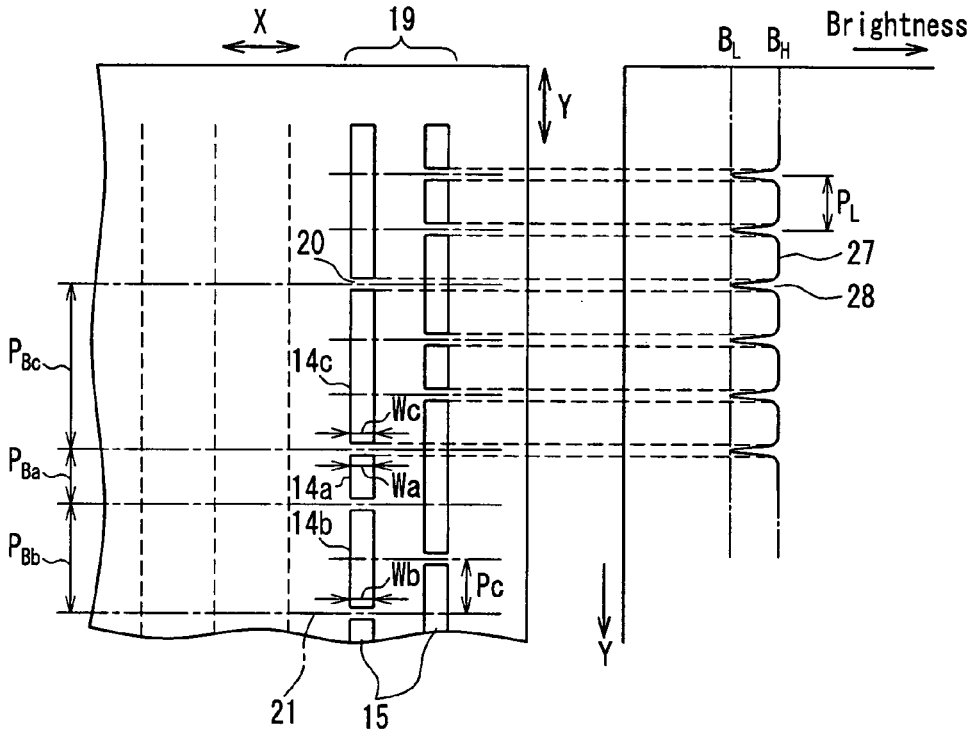
FIG. 5 is a view illustrating the mechanism by which the shadow mask of the color cathode-ray tube of the present invention suppresses the generation of a horizontal streak pattern.

Next, the function of the arrangement of apertures according to the present invention will be described. The left-side view on the drawing surface of FIG. 5 is an enlarged front view showing the arrangement of the apertures 14*a*, 14*b*, and 14*c*, and the bridges 20. The right-side view on the drawing surface is a brightness distribution diagram obtained by summing up two brightness distribution curves corresponding to two arrays of apertures adjacent in the horizontal direction shown on the left side of the drawing surface, among the brightness distribution curves in the vertical direction of phosphors that emit light due to electron beams passing through the apertures 14*a*, 14*b*, and 14*c* aligned in the vertical direction, obtained for each array of apertures 15. The reason for summing up the two brightness distribution curves respectively corresponding to two adjacent arrays of apertures is as follows: light-emitting portions of phosphors respectively corresponding to two adjacent arrays of apertures are sufficiently close to each other in the horizontal direction that they are difficult to be distinguished by the naked eye.

In the shadow mask of the present invention, each array of apertures 15 includes three kinds of apertures 14*a*, 14*b*, and 14*c* having different vertical widths. Vertical spacings $P_{Ba}$, $P_{Bb}$, and $P_{Bc}$ between the horizontal center lines 21, 21 of the pairs of the bridges 20, 20 that respectively sandwich the apertures 14*a*, 14*b*, and 14*c* in the vertical direction satisfy the relationships: $P_{Bb}=N1\times P_{Ba}$ and $P_{Bc}=N2\times P_{Ba}$, assuming that N1, N2 are natural numbers ($1<N1<N2$). Therefore, as shown in the brightness distribution diagram on the right side of FIG. 5, it becomes easy to decrease the vertical pitch $P_L$ of the portions exhibiting the low brightness level $B_L$. Consequently, the generation of a horizontal streak pattern can be suppressed.

In the present embodiment, the shadow mask has been described, which has three kinds of apertures (first apertures 14*a*, second apertures 14*b*, and third apertures 14*c*) having different vertical widths. However, the present invention is not limited thereto. For example, the shadow mask may have other kinds of apertures fourth apertures, fifth aperture, . . . ) in addition to these three kinds of apertures. Even in this case, the other kinds of apertures have different vertical widths, and a vertical spacing $P_{BN}$ between a pair of bridges that sandwich each aperture in the vertical direction is set to be a natural number multiple of the vertical spacing $P_{Ba}$ between a pair of bridges that sandwich each first aperture in the vertical direction. Regarding the kind of the apertures, at least three kinds are required; however, in the case where it is desired to prevent the arrangement of the apertures from being complicated, too many kinds of apertures are not preferable.

Furthermore, as shown in FIG. 5, it is preferable that the horizontal center lines 21 with respect to all the bridges 20 included in arbitrary pairs of the arrays of apertures 15 adjacent in the horizontal direction are arranged at a substantially constant spacing in the vertical direction (this spacing will be referred to as a "bridge arrangement basic spacing $P_C$"). In other words, any bridges 20 included in arbitrary pairs of the arrays of apertures 15 adjacent in the horizontal direction are arranged substantially along any of a number of horizontal center lines 21 arranged at an equal spacing (at the spacing $P_C$) on the shadow mask 5. Due to such an arrangement of the bridges 20, as shown on the right-side view of FIG. 5, all the vertical pitches $P_L$ of the low brightness level $B_L$ are substantially constant over the entire shadow mask. Since the distance between the shadow mask and the phosphor screen is small, the vertical pitch $P_L$ is substantially matched with the spacing $P_C$, and is substantially matched with the vertical spacing $P_{Ba}$ between the horizontal center lines 21, 21 of the pairs of the bridges 20, 20 that respectively sandwich the first apertures 14*a* with a smallest vertical width. Consequently, the generation of a horizontal streak pattern can be suppressed further. In order to realize this, for example, $P_{Bb}=2\times P_{Ba}$, and $P_{Bc}=3\times P_{Ba}$ may be set.

The arrays of apertures 15 may have apertures of other sizes than those of the above-mentioned three kinds of apertures 14*a*, 14*b*, and 14*c*. Even in this case, it is preferable that, among the apertures included in the array of apertures 15, the vertical spacings between the horizontal center lines 21, 21 of the pairs of the bridges 20, 20 that respectively sandwich the apertures having a largest vertical width in the vertical direction are 3 mm or less. More preferably, the arrays of apertures 15 include only the above-mentioned three kinds of apertures 14*a*, 14*b*, and 14*c*, and the vertical spacings $P_{Bc}$ with respect to the third apertures 14*c* are 3 mm or less. Because of this, the increase in the vertical pitch $P_L$ of the low brightness level $B_L$ can be suppressed, so that the generation of a horizontal streak pattern can be prevented further.

Furthermore, assuming that the aperture widths in the horizontal direction of the first apertures 14*a*, the second apertures 14*b*, and the third apertures 14*c* are $W_a$, $W_b$ and $W_c$, respectively, it is preferable that the relationships: $W_a>W_b$ and $W_a>W_c$ are satisfied. Furthermore, it is more preferable that the relationship: $W_a>W_b>W_c$ is satisfied. Thus, by setting the horizontal width to be larger for an aperture with a smaller vertical width, the following effects can be obtained.

The first effect is as follows. As a method for forming phosphor stripes on the phosphor screen 2*a*, an exposure method generally is used, in which phosphor stripes are formed by light exposure, using the shadow mask 5 as a mask. In this exposure method, when the illumination of light is varied, the widths of phosphor stripes to be formed also are varied. In the case where the horizontal widths of all the apertures are constant, the illumination of light passing through apertures with a small bridge spacing becomes smaller than that of light passing through apertures with a large bridge spacing. As described above, as the vertical widths of the apertures are smaller, by setting the horizontal widths thereof to be large, the illumination difference caused by the difference in vertical width can be decreased, so that phosphor stripes can be formed with a uniform width.

The second effect is as follows. In the case where the horizontal widths of all the apertures are constant, the illumination of light passing through apertures with a small bridge spacing becomes smaller than that of light passing through apertures with a large bridge spacing. Therefore, a difference in light-emitting brightness of phosphors is caused. More specifically, the high brightness level $B_H$ is likely to be varied. As described above, as the vertical widths of the apertures are smaller, by setting the horizontal widths thereof to be large, the difference in light-emitting brightness caused by the difference in vertical width can be decreased, so that the brightness difference over the entire screen can be decreased to enhance a display quality.

Next, the reduction in doming will be described.

Figure 6:
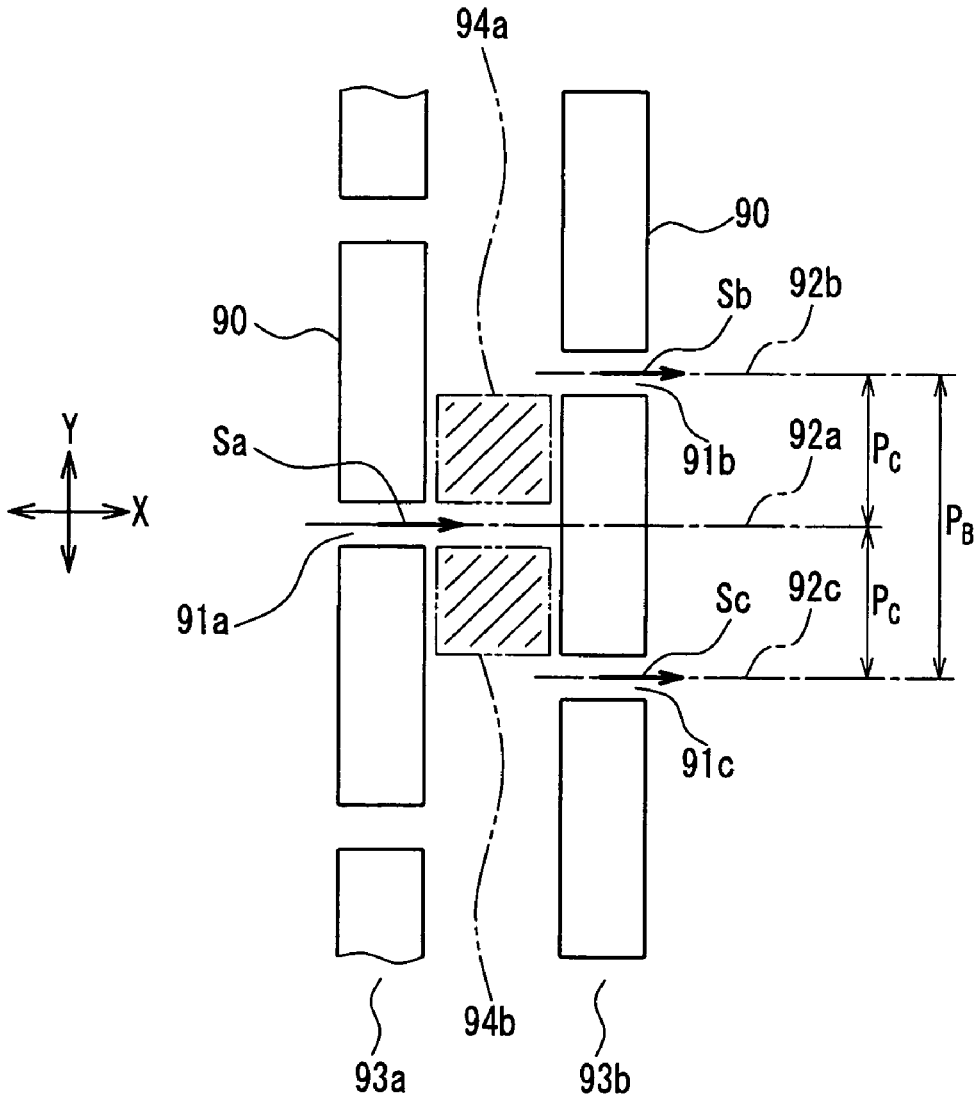
FIG. 6 PRIOR ART
FIG. 6 is a view illustrating the mechanism of the occurrence of doming in a conventional tension-type shadow mask.

FIG. 6 is a view illustrating the mechanism of the occurrence of doming in a conventional tension-type shadow mask, in which a number of apertures 90 of the same size are formed, shown in FIG. 10. As described above, in the tension-type shadow mask, the thermal expansion in a tension direction (vertical direction) is substantially absorbed by applied tension. Therefore, in particular, the thermal expansion in the horizontal direction is a problem. The thermal expansion in the horizontal direction is transmitted via bridges. For example, it is assumed that a displacement Sa in the horizontal direction is transmitted to the bridges 91*a* due to thermal expansion. The displacement Sa is transmitted to the bridges 91*b*, 91*c* via regions 94*a*, 94*b* between arrays of apertures 93*a* and 93*b*, whereby displacements Sb, Sc in the horizontal direction are caused in the bridges 91*b*, 91*c*. Thus, due to the displacement in the horizontal direction of bridge positions, the apertures sandwiched by the bridges also are displaced in the horizontal direction. Therefore, doming occurs, and color displacement is caused.

As is understood from FIG. 6, in order to prevent the occurrence of doming, first, it is preferable that bridges included respectively in arbitrary pairs of the arrays of apertures adjacent in the horizontal direction are not aligned side by side in the horizontal direction. Furthermore, second, it is preferable that the bridges included respectively in arbitrary pairs of the arrays of apertures adjacent in the horizontal direction are apart from each other in the vertical direction. The second condition will be described with reference to FIG. 7.

Figure 7:
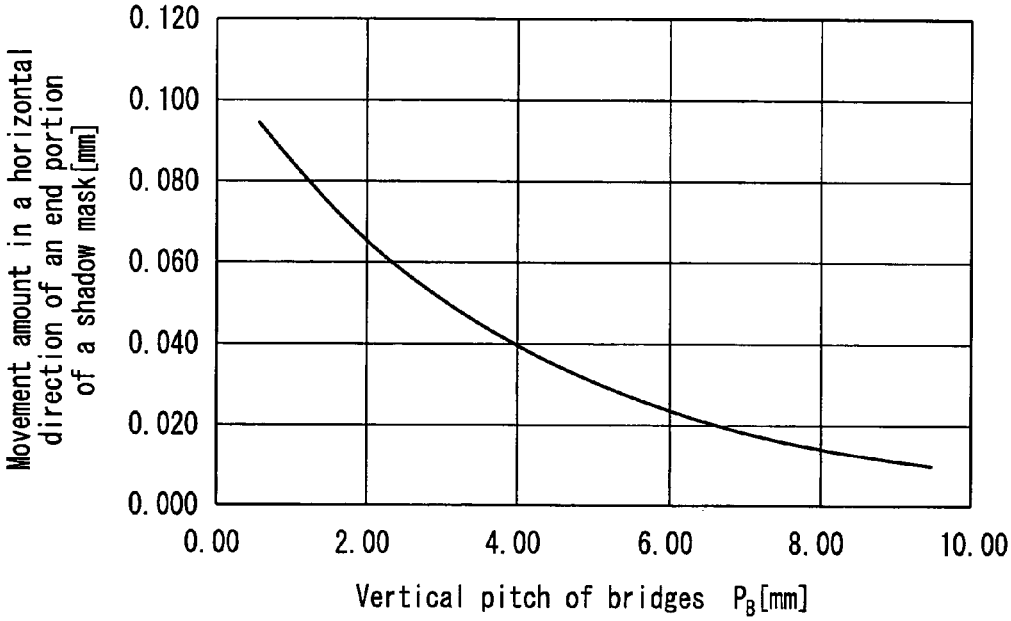
FIG. 7 PRIOR ART
FIG. 7 is a view showing the relationship between a vertical pitch of bridges and doming in the conventional tension-type shadow mask.

FIG. 7 shows the relationship between a vertical pitch $P_B$ of the bridges 91 in each array of apertures of a conventional tension-type shadow mask, in which a number of apertures 90 of the same size are formed, shown in FIG. 10, and the movement amount in the horizontal direction of a horizontal end portion on an X-axis of the shadow mask due to the thermal expansion of the shadow mask under irradiation with electron beams. It is understood from FIG. 7 that when the vertical pitch $P_B$ of the bridges 91 is increased, the horizontal movement amount (doming) of the end portion due to the thermal expansion of the shadow mask is reduced. This means that the thermal expansion in the horizontal direction of the shadow mask is transmitted via the bridges 91, as described above. In order to suppress color displacement due to doming, it is understood that it is effective to increase the vertical pitch $P_B$ of the bridges. In other words, in FIG. 6, assuming that the horizontal lines passing through the centers in the vertical direction of the bridges 91*a*, 91*b*, and 91*c* are horizontal center lines 92*a*, 92*b*, and 92*c*, it is effective to extend the vertical spacing thereof (bridge arrangement basic spacing) $P_C$ (in the present example, $P_C=P_B/2$). When the vertical pitch $P_B$ of the bridges and the bridge arrangement basic spacing $P_C$ are extended, the arrangement density of the bridges is reduced, and the opening ratio of the shadow mask is increased, which also is effective for enhancing the brightness of a displayed image.

However, in the conventional shadow mask shown in FIG. 10, when the vertical pitch $P_B$ and the spacing $P_C$ are increased, there is a problem that the vertical pitch $P_L$ of the low brightness level $B_L$ is increased, whereby black horizontal streaks are recognized, as described with reference to FIGS. 4A and 4B.

The mechanism by which the present invention can reduce doming and a horizontal streak pattern simultaneously will be described with reference to FIG. 8. (A) through (C) show arrangement patterns of apertures in two adjacent arrays of apertures. (A) and (B) are exemplary embodiments corresponding to the present invention, and (C) corresponds to the conventional shadow mask shown in FIG. 10. In (B), the first apertures 14*a*, the second apertures 14*b*, and the third apertures 14*c* are arranged repeatedly in this order in each array of apertures. In (A), the first apertures 14*a*, the second apertures 14*b*, and the third apertures 14*c* are arranged in a random order in each array of apertures. For ease of comparison, the spacing $P_C$ between the horizontal center lines 21 with respect to all the bridges included in two adjacent arrays of apertures is set to be the same in (A) through (C). Thus, the vertical pitch $P_L$ of the low brightness level $B_L$ also is the same and how a horizontal streak pattern is seen is substantially the same, in (A) through (C).

Rectangular regions 24 in (A) through (C) show those (displacement transmission regions) that contribute to the transmission of a horizontal displacement between the bridges of one array of apertures and the bridges of another array of apertures, which correspond to the regions 94*a*, 94*b* described with reference to FIG. 6. As shown in FIG. 8, a portion between two adjacent arrays of apertures is divided into 13 regions by the horizontal center lines 21. In (C), all 13 regions are the displacement transmission regions 24 (13/13×100=100%). In contrast, in (A), 8 regions 1, 3, 4, 6, 8, 9, 11, and 13 (8/13×100=62%) among 13 regions are the displacement transmission regions 24. Furthermore, in (B), 9 regions 1, 3, 4, 5, 7, 9, 10, 11, and 13 (9/13×100=69%) among 13 regions are the displacement transmission regions 24. More specifically, in (A) and (B), the area ratio of the displacement transmission regions 24 with respect to the portion between two adjacent arrays of apertures is smaller, compared with that in (C), so that the occurrence of doming can be reduced.

In the case of a conventional aperture arrangement as shown in (C), in order to prevent doming, it was necessary to extend the bridge arrangement basic spacing $P_C$. However, when the spacing $P_C$ is extended, there is a problem in that a horizontal streak pattern is generated. In contrast, according to the aperture arrangements of the present invention as shown in (A) and (B), the area ratio of the displacement transmission regions 24 is small; therefore, even when the bridge arrangement basic spacing $P_C$ is not extended, the occurrence of doming can be prevented. Furthermore, since it is not necessary to extend the spacing $P_C$, a horizontal streak pattern is not generated. Thus, according to the present invention, doming and a horizontal streak pattern can be suppressed simultaneously. Thus, a color cathode-ray tube with a display image quality enhanced can be provided.

EXAMPLES

Examples in which the present invention is applied to a wide-type color cathode-ray tube of a screen diagonal size of 76 cm will be described.

Figure 8:
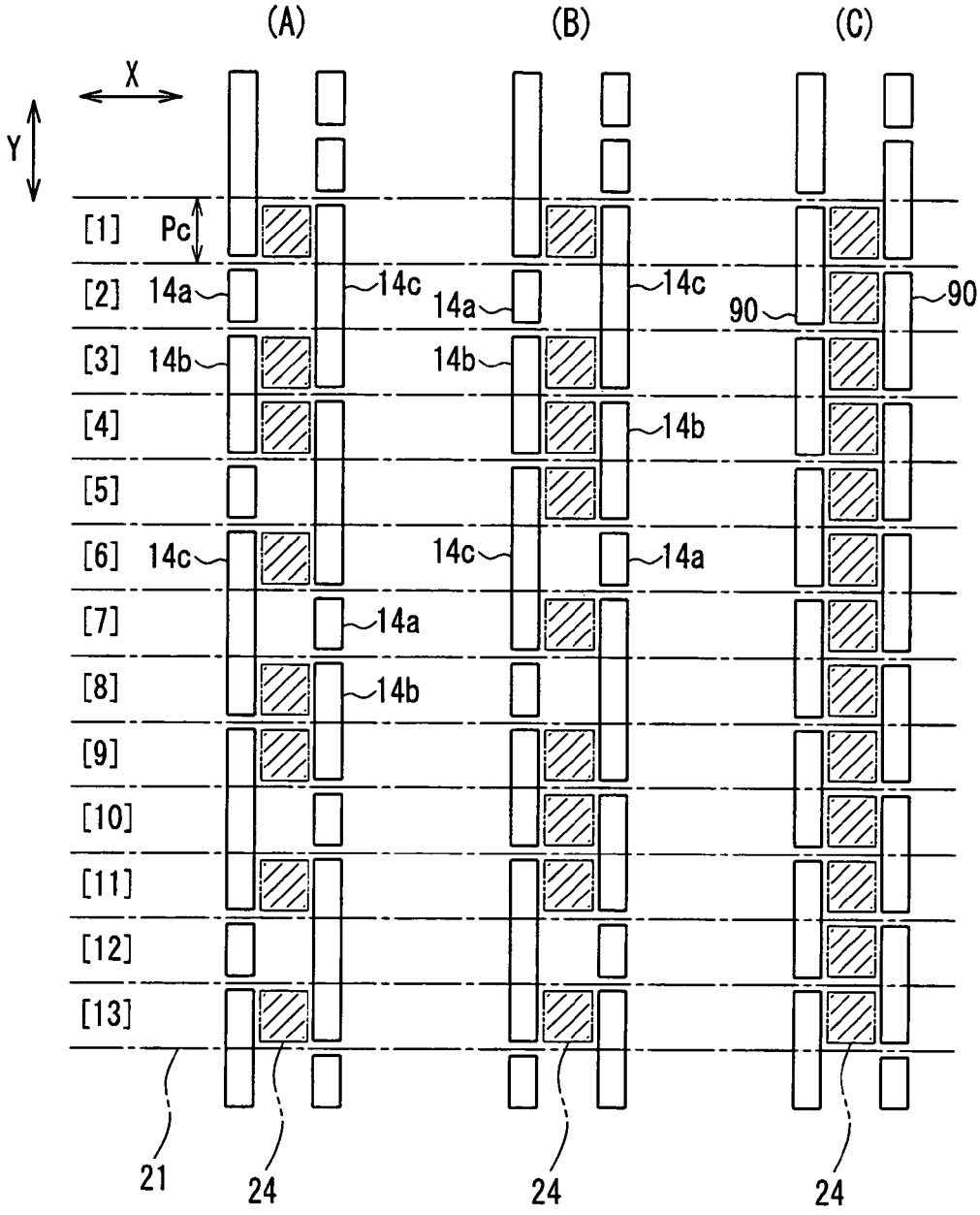
FIG. 8 is a view illustrating the mechanism by which the shadow mask of the present invention can suppress doming.
Figure 9:
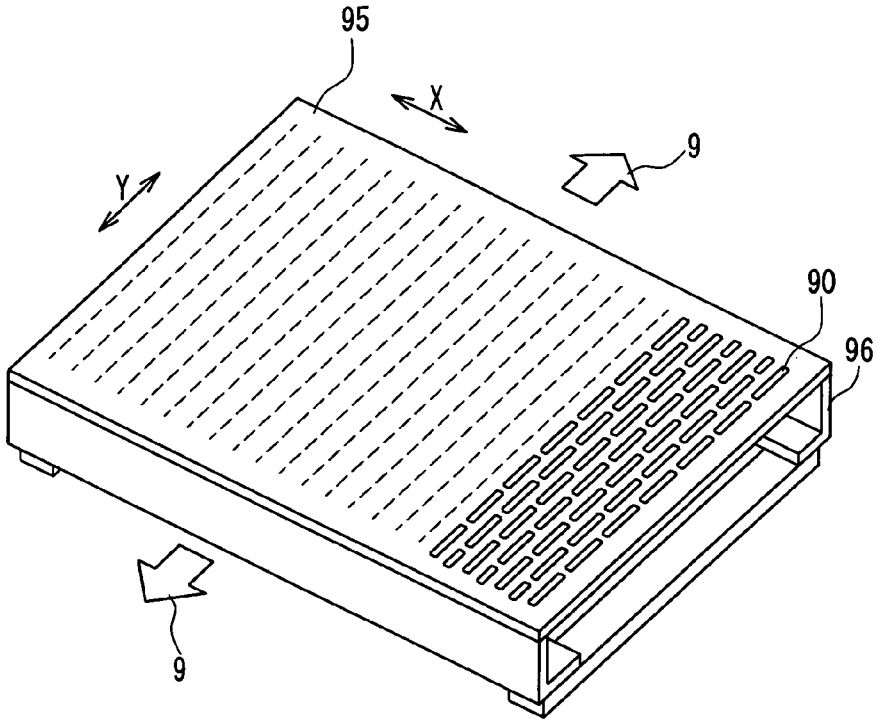
FIG. 9 PRIOR ART
FIG. 9 is a perspective view showing one embodiment of an assembly including a shadow mask and a mask frame to be mounted on a conventional color cathode-ray tube.

Shadow masks respectively having aperture arrangements in which two arrays of apertures shown in (A), (B), and (C) in FIG. 8 are repeated in a horizontal direction (assumed to be Example 1, Example 2, and Comparative Example 1 in this order) were produced. In the shadow masks of Examples 1 and 2, the vertical spacings $P_{Ba}$, $P_{Bb}$, and $P_{Bc}$ between the horizontal center lines 21, 21 of the pairs of the bridges 20, 20 that respectively sandwich the apertures 14*a*, 14*b*, and 14*c* in the vertical direction were set to be 0.71 mm, 1.42 mm, and 2.13 mm, respectively, and the horizontal widths $W_a$, $W_b$, and $W_c$ of the apertures 14*a*, 14*b*, and 14*c* were set to be 0.125 mm, 0.123 mm, and 0.120 mm. In the shadow mask of Comparative Example 1, the vertical spacing $P_B$ between the horizontal center lines 92, 92 of the pairs of the bridges 91, 91 that respectively sandwich the apertures 90 in the vertical direction was set to be 1.42 mm, and the horizontal width of the aperture 90 was set to be 0.120 mm. The horizontal pitch of arrays of apertures was set to be 0.49 mm in (A) through (C). In (A) through (C), the bridge arrangement basic spacing $P_C$ was set to be the same (i.e., 0.71 mm).

Similar color cathode-ray tubes were produced using the above-mentioned three kinds of shadow masks, except for the aperture arrangements of the shadow masks being varied.

In any of the color cathode-ray tubes of Examples 1, 2, and Comparative Example 1, no black horizontal streak pattern due to shadows of bridges was recognized. According to the study by the inventors of the present invention regarding a wide-type color cathode-ray tube with a screen diagonal size of 76 cm, it is confirmed that a horizontal streak pattern is not recognized as long as the vertical pitch $P_L$ ($\approx P_C$) of the low brightness level $B_L$ described with reference to FIGS. 4A, 4B, and 5 is 0.9 mm or less.

On the other hand, regarding doming, the horizontal movement amount of the apertures at an end portion on the X-axis of the shadow mask was measured to be about 50 μm in Examples 1 and 2, whereas it was measured to be about 90 μm in Comparative Example 1.

In Comparative Example 1, in order to set the above-mentioned horizontal movement amount of the apertures to be the same (i.e., about 50 μm) as those of Examples 1 and 2, it is necessary to extend the vertical spacing $P_B$ of the bridges to 3.00 mm and the bridge arrangement basic spacing $P_C$ to 1.50 mm, respectively. In this case, it was confirmed that the spacing $P_C$ exceeds 0.9 mm that is an upper limit at which a horizontal streak pattern is not generated.

Thus, in Examples 1 and 2, it was found that a horizontal streak pattern and doming can be reduced simultaneously.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color cathode-ray tube, comprising a frame, and a shadow mask stretched on the frame in such a manner that tension is applied to the shadow mask in a vertical direction, wherein the shadow mask includes a plurality of arrays of apertures in the vertical direction, the arrays of apertures include a first aperture, a second aperture, a third aperture, and bridges between the apertures, assuming that a horizontal line passing through a center in the vertical direction of each of the bridges is a horizontal center line, and vertical spacings between the horizontal center lines of pairs of the bridges that respectively sandwich the first aperture, the second aperture, and the third aperture in the vertical direction are $P_{Ba}$, $P_{Bb}$, and $P_{Bc}$ in this order, relationships: $P_{Bb}=N\mathbf{1}\times P_{Ba}$ and $P_{Bc}=N\mathbf{2}\times P_{Ba}$ (N1, N2 are natural numbers, $1<N\mathbf{1}<N\mathbf{2}$) are satisfied, and vertical spacings between the horizontal center lines with respect to all the bridges included in arbitrary pairs of the arrays of apertures adjacent in a horizontal direction are substantially constant.

2. The color cathode-ray tube according to claim 1, wherein the vertical spacing between the horizontal center lines of the pair of the bridges that sandwich an aperture having a largest vertical width in the vertical direction, among the apertures included in the arrays of apertures, is 3 mm or less.

3. The color cathode-ray tube according to claim 1, wherein assuming that horizontal widths of the first aperture, the second aperture, and the third aperture are $W_a$, $W_b$, and $W_c$, respectively, relationships: $W_a>W_b$ and $W_a>W_c$ are satisfied.

4. The color cathode-ray tube according to claim 1, wherein assuming that horizontal widths of the first aperture, the second aperture, and the third aperture are $W_a$, $W_b$, and $W_c$, respectively, a relationship: $W_a>W_b>W_c$ is satisfied.

5. The color cathode-ray tube according to claim 1, wherein the bridges included respectively in arbitrary pairs of the arrays of apertures adjacent in the horizontal direction are not aligned side by side in the horizontal direction.

6. The color cathode-ray tube according to claim 1, comprising an aperture arrangement pattern in which a repeating unit including two of the arrays of apertures adjacent in the horizontal direction is repeated in the horizontal direction.

* * * * *